US008800215B2

(12) United States Patent
Yoder

(10) Patent No.: US 8,800,215 B2
(45) Date of Patent: Aug. 12, 2014

(54) SELF-CONTAINED PORTABLE CONTAINER HABITAT FOR USE IN RADIOLOGICAL ENVIRONMENTS

(75) Inventor: Steven M. Yoder, Lake Ozark, MO (US)

(73) Assignee: Performance Contracting, Inc., Lenexa, KS (US)

( * ) Notice: Subject to any disclaimer, the term of this patent is extended or adjusted under 35 U.S.C. 154(b) by 17 days.

(21) Appl. No.: 13/590,361

(22) Filed: Aug. 21, 2012

(65) Prior Publication Data

US 2013/0047521 A1 Feb. 28, 2013

Related U.S. Application Data

(60) Provisional application No. 61/525,969, filed on Aug. 22, 2011.

(51) Int. Cl.

| | |
|---|---|
| ***E04H 1/00*** | (2006.01) |
| ***G21F 7/005*** | (2006.01) |
| ***G21F 3/00*** | (2006.01) |
| ***G21F 1/12*** | (2006.01) |
| *E04H 1/12* | (2006.01) |

(52) U.S. Cl.

CPC *G21F 7/005* (2013.01); *G21F 3/00* (2013.01); *E04H 2001/1283* (2013.01); *G21F 1/125* (2013.01)

USPC ..... 52/79.1

(58) Field of Classification Search

CPC ..... E04H 9/00; E04H 9/04; E04H 9/06; E04H 9/14; E04H 2001/1283; G21F 7/00; E04B 1/348; E04B 1/34861; E04B 1/34869

USPC ..... 52/79.1, 79.7, 79.8; 109/1 S

See application file for complete search history.

(56) References Cited

U.S. PATENT DOCUMENTS

| | | | | | |
|---|---|---|---|---|---|
| 2,773,459 | A | * | 12/1956 | Sechy | 109/82 |
| 3,008,435 | A | * | 11/1961 | Dupuy | 109/1 S |
| 4,074,141 | A | * | 2/1978 | Bryant | 250/517.1 |
| 4,299,066 | A | * | 11/1981 | Thompson | 52/81.6 |
| 4,350,813 | A | | 9/1982 | Takei et al. | |
| 4,483,273 | A | * | 11/1984 | Develle et al. | 109/1 S |
| 4,608,495 | A | | 8/1986 | Jacobson | |
| 4,748,790 | A | * | 6/1988 | Frangolacci | 52/794.1 |
| 4,833,335 | A | | 5/1989 | McGinley et al. | |

(Continued)

OTHER PUBLICATIONS

SILFLEX Lightweight, Non-Lead Shielding Blankets—MarShield custome radiation protection, shielding and storage (2 page brochure).

*Primary Examiner* — Christine T Cajilig

(74) *Attorney, Agent, or Firm* — Womble Carlyle Sandridge & Rice LLP

(57) ABSTRACT

A self-contained portable habitat apparatus may be used in a radiological environment. The habitat apparatus includes a outer container adapted for being portable and freestanding, and the outer container is outfitted to include a chamber structure within the outer container. The chamber structure at least partially defines in interior space for being occupied by one or more humans. The chamber structure may be adapted for attenuating gamma radiation. Regarding the chamber structure being adapted for attenuating gamma radiation, the chamber structure may comprise one or more liners and/or panels, such as structural insulated panels. The one or more liners and/or panels may comprise a flexible layer, and the flexible layer may comprise polymeric material and metal, wherein the metal is for attenuating radiation.

19 Claims, 7 Drawing Sheets

(56) References Cited

U.S. PATENT DOCUMENTS

| | | | | |
|---|---|---|---|---|
| 4,854,094 | A * | 8/1989 | Clark | 52/79.1 |
| 5,286,318 | A * | 2/1994 | Sims et al. | 156/71 |
| 6,226,932 | B1 * | 5/2001 | Friedrich | 52/79.1 |
| 7,418,802 | B2 * | 9/2008 | Sarine et al. | 52/79.5 |
| 7,511,292 | B2 | 3/2009 | Baudro | |
| 7,665,249 | B2 * | 2/2010 | Zeik et al. | 52/79.1 |
| 7,918,056 | B2 * | 4/2011 | Yamaguchi | 52/169.6 |
| 7,963,073 | B1 * | 6/2011 | Pellegrene et al. | 52/125.2 |
| 8,547,710 | B2 * | 10/2013 | Ruehl et al. | 361/816 |
| 2004/0025448 | A1 * | 2/2004 | Puusepp et al. | 52/64 |
| 2005/0193643 | A1 * | 9/2005 | Pettus | 52/79.1 |
| 2007/0130844 | A1 * | 6/2007 | Arts et al. | 52/79.1 |
| 2008/0035891 | A1 * | 2/2008 | Hayashi | 252/478 |
| 2008/0276554 | A1 * | 11/2008 | Sheetz | 52/239 |
| 2009/0125316 | A1 * | 5/2009 | Moore | 705/1 |
| 2010/0146870 | A1 * | 6/2010 | Zeik et al. | 52/79.1 |
| 2010/0193713 | A1 * | 8/2010 | Bichay | 250/517.1 |
| 2013/0014452 | A1 * | 1/2013 | Hill et al. | 52/79.1 |
| 2013/0036702 | A1 * | 2/2013 | Pacetti et al. | 52/653.2 |
| 2013/0111825 | A1 * | 5/2013 | Lefkus et al. | 52/79.1 |

* cited by examiner

SELF-CONTAINED PORTABLE CONTAINER HABITAT FOR USE IN RADIOLOGICAL ENVIRONMENTS

CROSS-REFERENCE TO RELATED APPLICATION

This application claims the benefit of U.S. Provisional Patent Application No. 61/525,969, which was filed Aug. 22, 2011.

INCORPORATION BY REFERENCE

The entire disclosure of U.S. Provisional Patent Application No. 61/525,969, which was filed Aug. 22, 2011, is incorporated herein by reference.

FIELD OF THE DISCLOSURE

This disclosure relates to portable habitats that are self-contained, and this disclosure also relates to enclosures for providing protection from radiation.

BACKGROUND

It is known to provide a habitat in a radiological environment, such as at a nuclear power plant, wherein the habitat is shielded from propagating radiation, such as alpha, beta and/or gamma radiation, and provisions are made to decontaminate any radioactive contamination from people and/or objects before they are allowed to enter the habitat. A control room is an example of such a habitat that may be built into a nuclear power plant.

Whereas efforts are made to plan in advance for radiological emergencies, it is common for suitable habitats to be in short supply after a radiological emergency.

BRIEF SUMMARY

One aspect if this disclosure is the provision of a self-contained portable container habitat for use in radiological environments, wherein the container habitat includes barriers to propagating radiation, such as alpha, beta and/or gamma radiation, and/or the container habitat includes one or more features for decontaminating any radioactive contamination from people and/or objects entering the habitat.

In accordance with one aspect of this disclosure, a portable habitat apparatus for being used in a radiological environment includes an outer container adapted for being portable and freestanding, and a chamber structure that is positioned in the outer container, wherein a substantial portion of the chamber structure may be adapted for attenuating gamma radiation more effectively than the outer container. The outer container may include a plurality of exterior walls that are respectively connected to one another, an opening, and at least one door mounted for opening and closing the opening. The chamber structure within the container may extend at least partially around and at least partially define an interior space that is positioned in the outer container and adapted for being inhabited by one or more humans. The outer container and the chamber structure may be cooperatively configured so that the interior space is for being accessed by way of the opening of the outer container. Regarding the chamber structure being adapted for attenuating gamma radiation, the chamber structure within the outer container may comprise one or more liners and/or panels, such as structural insulated panels. The one or more liners and/or panels may comprise a flexible layer, and the flexible layer may comprise polymeric material and metal, wherein the metal is for attenuating radiation. More specifically, the polymeric material may comprise silicone, and the metal may comprise at least one metal selected from the group consisting of tungsten and iron, and the metal may be impregnated in the silicone. Alternatively, the one or more liners and/or panels may comprise any other suitable structure for attenuating radiation, such as, but not limited to, a sheet of lead.

In one embodiment of this disclosure, the outer container includes upright first and second walls positioned at opposite sides of the outer container; and the chamber structure includes an upright first structural panel proximate and extending along the first wall, and an upright second structural panel proximate and extending along the second wall, wherein the first and second structural panels are respectively positioned at the opposite sides of the interior space. The chamber structure may further include an upper structural panel spanning between and supported by each of an upper edge of the first structural panel and an upper edge of the second structural panel. One or more of, such as each of, the first, second and upper structural panels may be configured for substantially attenuating at least gamma radiation. Each of the first, second and upper structural panels may include a layer comprising polymeric material and metal, wherein the metal is for attenuating radiation. More specifically, the polymeric material may comprise silicone, and the metal may comprises at least one metal selected from the group consisting of tungsten and iron, and the metal may be impregnated in the silicone.

According to one embodiment of this disclosure, the chamber structure at least partially defines first and second portions of the interior space that are within the outer container, the first portion of the interior space is for being accessed by way of the opening of the outer container, and the second portion of the interior space is for being accessed by way of the first portion of the interior space. The chamber structure may be adapted to attenuate radiation more effectively than the outer container, and the shielding provided by the chamber structure may be more effective for the second portion of the interior space than the first portion of the interior space.

In one aspect of this disclosure, the outer container may be outfitted with the chamber structure such that the chamber structure is mounted within the outer container for traveling with the outer container, and then the habitat apparatus may be delivered to a radiological environment. The outer container may be a trailer, and the delivering may comprise pulling the trailer with a tractor vehicle. Alternatively, the container may be an intermodal container, and the delivering may comprise one or more of: mounting the intermodal container on a flatbed semi-trailer and pulling the flatbed semi-trailer with a tractor vehicle, mounting the intermodal container on a railroad car and pulling the railroad car with a locomotive, and mounting the intermodal container on a ship and operating the ship so that the ship carries the container.

The foregoing presents a simplified summary of some aspects of this disclosure in order to provide a basic understanding. The foregoing summary is not an extensive summary of the disclosure and is not intended to identify key or critical elements of the invention or to delineate the scope of the invention. The purpose of the foregoing summary is to present some concepts of this disclosure in a simplified form as a prelude to the more detailed description that is presented later. For example, other aspects of this disclosure will become apparent from the following.

BRIEF DESCRIPTION OF THE DRAWINGS

Having described some aspects of this disclosure in general terms, reference will now be made to the accompanying drawings, which are schematic and not necessarily drawn to scale. The drawings are exemplary only, and should not be construed as limiting the invention.

FIG. 7 is also representative of a rear pictorial view of the panel, in accordance with first embodiment.

FIG. 9 is also illustrative of the habitat apparatus comprising a semi-trailer.

DETAILED DESCRIPTION

Exemplary embodiments of this disclosure are described below and numerous features are illustrated in the accompanying figures, in which like numerals refer to like parts throughout the several views. The following description provides examples and should not be interpreted as limiting the scope of the invention.

Figure 1:
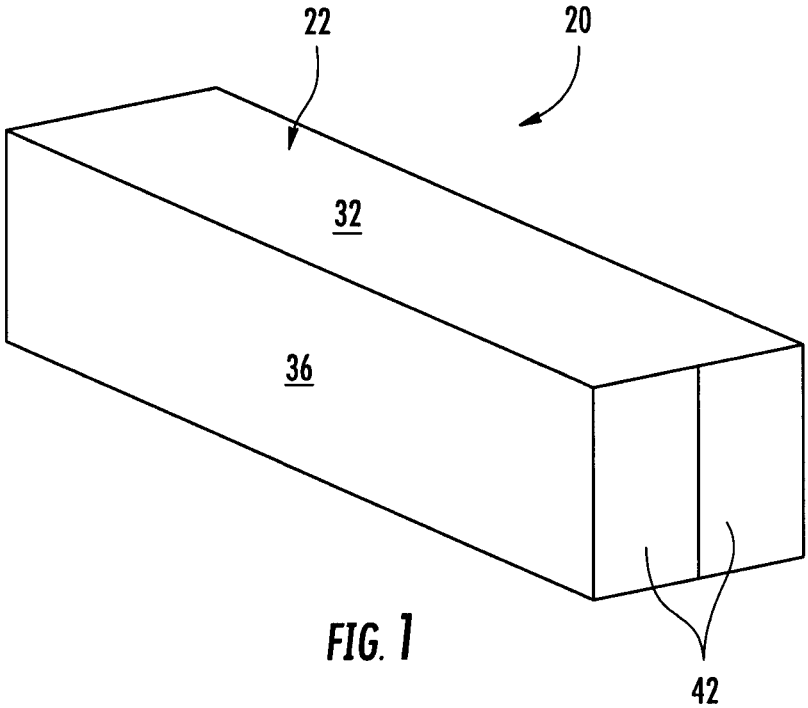
FIG. 1 is a rear pictorial view of a portable habitat apparatus in a closed configuration, in accordance with a first embodiment of this disclosure.
Figure 2:
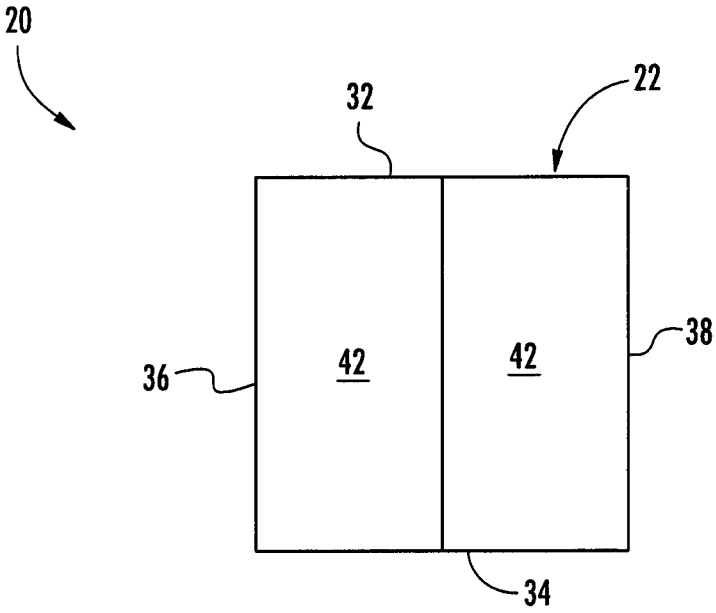
FIG. 2 is a rear elevation view of the habitat apparatus in its closed configuration.

In the following, a self-contained portable container habitat 20 ("habitat apparatus") is disclosed in accordance with a first embodiment of this disclosure. Referring to FIGS. 1 and 2, the habitat apparatus 20 includes an outer container 22 that is configured for being portable and freestanding. The container 22 considered alone and including its inherent characteristics, such as it being portable and freestanding, are conventional. As will be discussed in greater detail below, the inside of the container 22 is outfitted so that at least one interior space within the container is configured for being inhabited by one or more humans while the habitat apparatus 20 is in a radiological environment. That is, the interior space of the habitat apparatus 20 may be occupied by one or more humans while the habitat apparatus is in a radiological environment.

The container 22 may be a conventional box-shaped container such as, but not limited to, a substantially parallelepipedal intermodal container, or a conventional, substantially parallelepipedal trailer, such as a semi-trailer. For example, the container 20 is shown as being in the form of an intermodal container in FIGS. 1-6. As one example, the container may be about eight feet tall and wide, and about forty feet long. Alternatively, any other suitable type or size of container may be used. In contrast to the inside of the container 22 being outfitted, when the container 22 is selected from suitable types of containers, the outside of the container is typically not outfitted beyond its conventional state, so that the container 20, and thus the habitat apparatus 20, may be conveniently transported in a manner that is conventional for transporting containers of the type from which the container was selected, as will be discussed in greater detail below. On the other hand and depending on the condition of the container 22, the outside of the container may be repaired or maintained in a manner intended to return the exterior of the container to its original conventional condition, such as by painting the exterior of the container and/or performing any other maintenance that may be necessary or desired. The portable and freestanding nature of the container 22 is retained in the habitat apparatus 20, so that the habitat apparatus is both portable and freestanding.

The container 22 includes a front wall 30, and top, bottom, right and left walls 32, 34, 36, 38 that extend from the front wall to the rear end of the container. Whereas a frame of reference has been selected for use in this Detailed Description section of this disclosure, and the selected frame of reference has been used, for example, with respect to the names given to the walls 30, 32, 34, 36, 38, this disclosure is not limited to the frame of reference used herein, and any other suitable frame of reference may be used. For example, the front wall 30 may alternatively be referred to as a rear wall, the right wall the 36 may alternatively be referred to as a left wall, and the left wall 38 may alternatively be referred to as the right wall. The top and bottom walls 32, 34 may be referred to as a roof and floor, respectively.

The rear end of the container 22 defines an exterior access opening 40 that is opened and closed by at least one access door, such as right and left exterior access doors 42 of the container that are respectively pivotably mounted by hinges to the rear ends of the right and left side walls 36, 38. The rear end of the container 22 may alternatively be referred to as the front end of the container. The exterior access doors 42 typically include conventional latching and locking features for releasably securing the exterior access doors in their closed configuration. The rear ends of the right and left side walls 36, 38 may be characterized as being, or may be in the form of, right and left uprights of a access door frame. Alternatively, the exterior access opening 40/the rear end of the container 22 may be opened and closed by one or more of any other suitable types of access doors, such as, but not limited to, a basic overhead access door, or a roller shutter or sectional overhead access door. In addition, the exterior access opening 40, or an additional exterior access opening may be defined in the front, right or left walls 30, 36, 38. The outfitting of the container 22 may be adjusted accordingly.

The walls 30, 32, 34, 36, 38 and exterior access doors 42 of the container 22 are typically made of steel, although they may be made of any other suitable material. The edges of the walls 30, 32, 34, 36, 38 are respectively securely welded together or welded to a frame of the container. In the first embodiment, except for the exterior access opening 40, the walls 30, 32, 34, 36, 38 and exterior access doors 42 are typically substantially absent of any holes extending therethrough, and the latched closed exterior access doors 42 seal the exterior access opening 40 closed so that the latched closed container 22 may be substantially impervious to air and water. On the other hand, the latched closed container 22 may experience a small amount of leakage of air and/or water, so long as the leakage is small enough not to interfere with the operability of the portable habitat apparatus 20. Notwithstanding, typically the latched closed container 22 is substantially impervious to falling rain, and provisions may be made to accommodate for any latched closed container 22 not being fully impervious to air, as will be discussed in greater detail below.

Regarding the outfitting of the inside of the container 22, a chamber structure is constructed in the container. At least a substantial portion of the chamber structure may be adapted for attenuating gamma radiation more effectively than the container 22, as will be discussed in greater detail below. In the first embodiment, the chamber structure may be in the form of a liner or inner container that comprises interior front, top, bottom, right, left, rear and divider walls 50, 52, 54, 56, 58, 60, 62. The interior top and bottom walls 52, 54 may be referred to as a ceiling and floor, respectively. The interior top, bottom, right and left walls 52, 54, 56, 58 extend from the interior front wall 50 to the interior rear wall 60. In the first embodiment, the chamber structure, or more specifically its plurality of interior walls 50, 52, 54, 56, 58, 60, substantially fully lines the interior of the container 22 so that the chamber structure may be characterized as extending around and defining the interior space that is positioned in the container. Alternatively, the chamber structure, or more specifically its plurality of interior walls 50, 52, 54, 56, 58, 60, may be characterized as extending at least partially around and at least partially defining the interior space because, for example, a portion of one or more of the interior walls 50, 52, 54, 56, 58, 60 may optionally be omitted. As a more specific example, optionally, in some situations, the interior bottom wall 54, or a portion thereof, may be omitted, so that the bottom wall 34 of the container 22 may at least partially define the interior space.

The interior rear wall 60 at least partially defines an outer access opening 64 (FIG. 3) that is adjacent to the exterior access opening 40, so that the interior space may be accessed by way of a pathway that extends through the exterior and outer access openings 40, 64. The outer access opening 64 is opened and closed by at least one access door, such as an outer access door 66 of the chamber structure that is pivotably mounted to the rear interior wall 60. The portion of the rear interior wall 60 that defines the outer access opening 64 may be characterized as being, or may be in the form of, an outer access door frame 68 to which the outer access door 66 is pivotably attached with hinges. Alternatively, outer access opening 64 may be opened and closed by one or more of any other suitable types of access doors, such as, but not limited to, a basic overhead access door, or a roller shutter or sectional overhead access door. As another option, the outer access door 66 may be in the form of a access door formed by a series of overlapping, flexible strips hanging down from the top of the outer access opening 64.

The chamber structure may be configured so as to comprise two, three or more subchamber structures, and similarly the interior space may be configured so as to comprise two, three or more subinterior spaces. For example, the cross-wise and staggered arrangement of the divider walls 62 (FIGS. 4 and 5) divide the interior space into outer and inner subinterior spaces 70, 72. More specifically, the chamber structure comprises outer and inner subchamber structures 74, 76 that are positioned in the container 22, and the outer and inner subchamber structures define, or at least partially define, the outer and inner subinterior spaces 70, 72, respectively. The subchamber structures 74, 76 may be referred to as subchambers.

One or more of the subchambers 74, 76 may be configured in any suitable manner for allowing occupants of the interior space to pass back and forth between the outer and inner subinterior spaces 70, 72. For example, whereas the cross-wise and staggered arrangement of the divider walls 62 at least partially define a sinuous passageway 80 between the outer and inner subinterior spaces 70, 72, that passageway between the outer and inner subinterior spaces 70, 72 may be in any other suitable shape. The sinuous passageway 80 is schematically illustrated by a dashed, double-ended arrow in FIG. 5.

Figure 4:
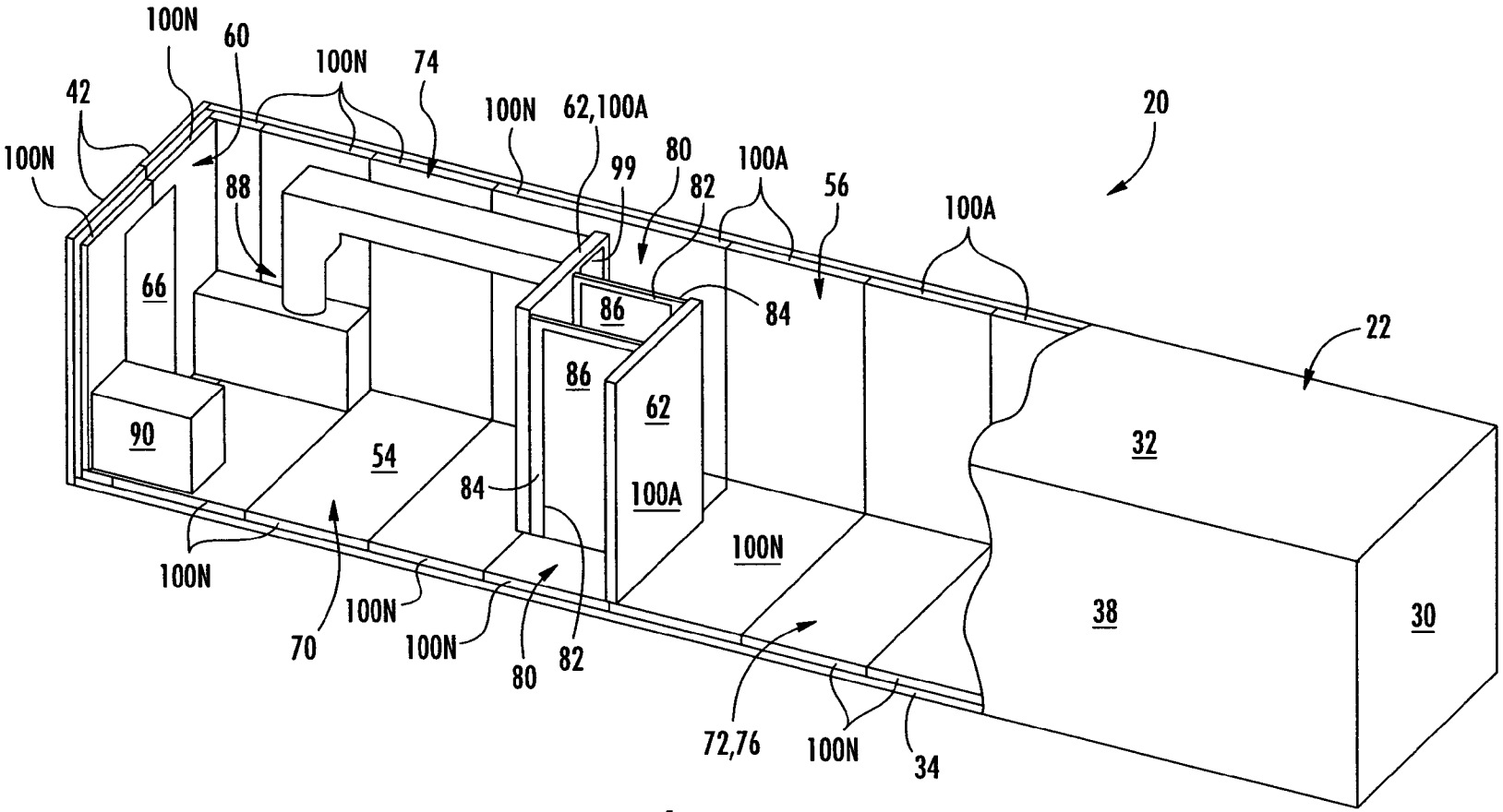
FIG. 4 is a front pictorial view of the habitat apparatus with rear portions of exterior and interior left and top walls removed, and the exterior and outer access openings closed, in accordance with the first embodiment.
Figure 5:
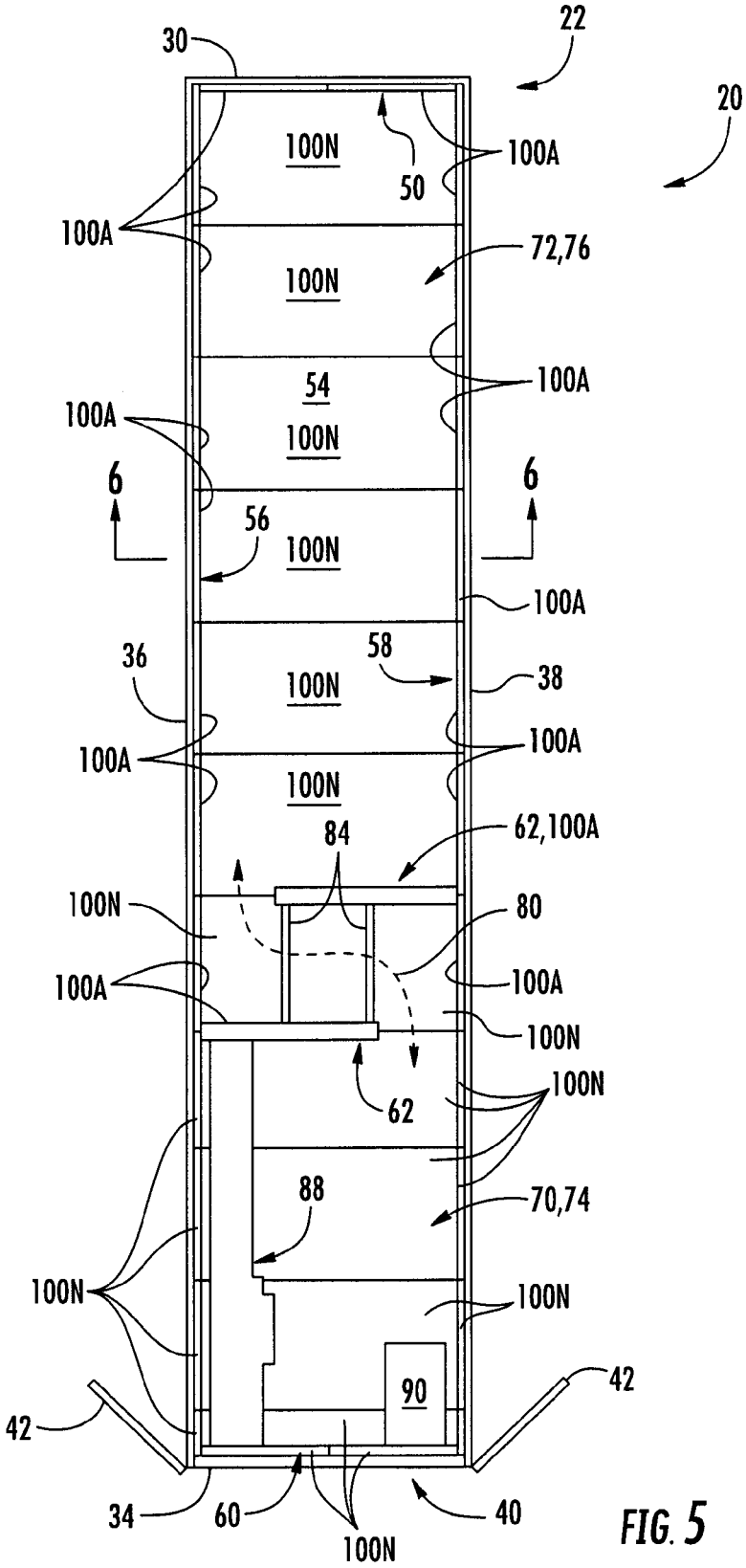
FIG. 5 is a top plan view of the habitat apparatus with its exterior and interior top walls removed, in accordance with the first embodiment.
Figure 6:
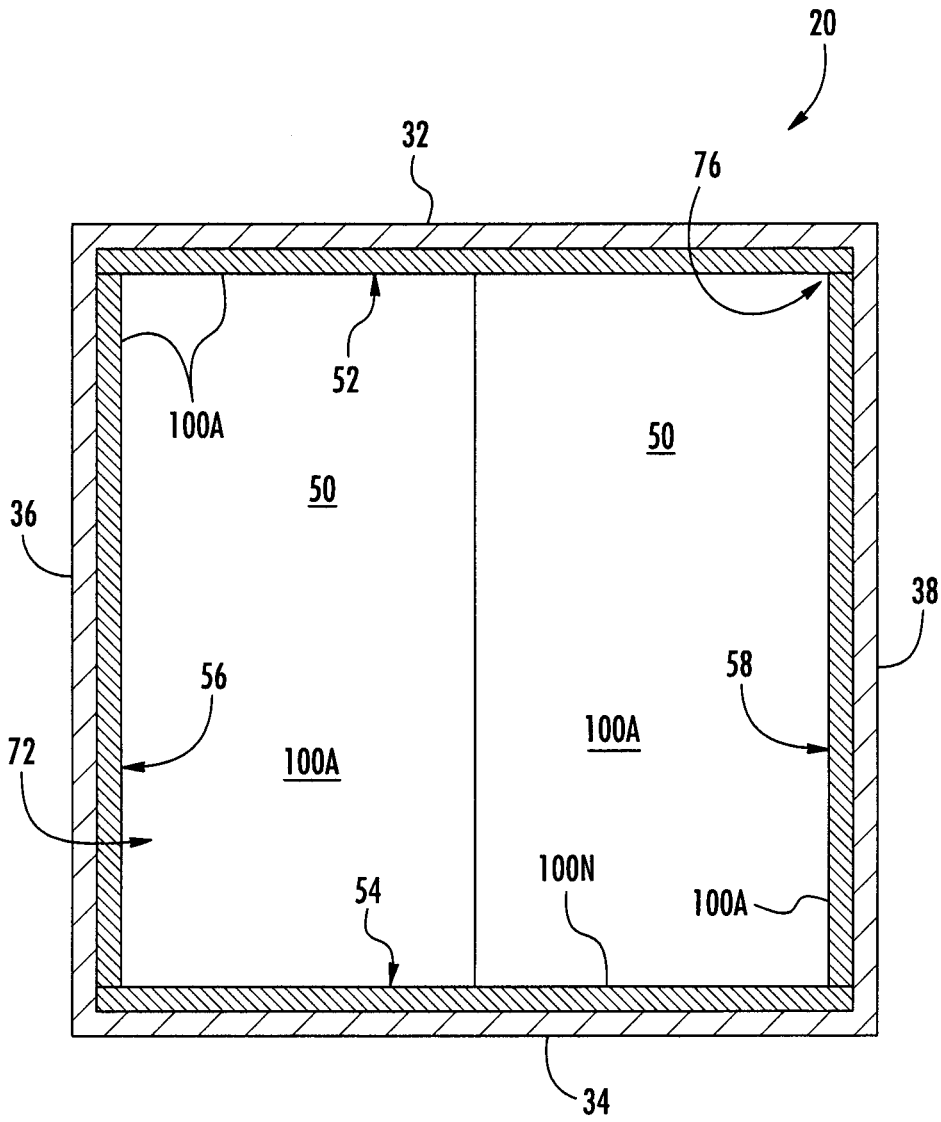
FIG. 6 is a cross-sectional view of the habitat apparatus inclusive of the exterior and interior top walls, with the cross-section taken along line 6-6 of FIG. 5, in accordance with the first embodiment.

Referring to FIG. 4, the chamber structure, or more specifically the inner subchamber 76, or even more specifically the sinuous passageway 80, comprises and/or at least partially defines one or more inner access openings 82, or more specifically two inner access openings, or any other suitable number of the inner access openings. The two inner access openings 82 may be at least partially defined by spaced apart inner access door frames 84 of the inner subchamber 76. The inner access door frames 84 are mounted crosswise between the divider walls 62. For each of the inner access door frames 84, the inner access opening 82 thereof is opened and closed by at least one access door, such as an inner access door 86 of the inner subchamber 76. The inner access doors 86 are pivotably mounted to the inner access door frames 84 by hinges. Alternatively, for each of the inner access door frames 84, the inner access opening 82 thereof may be opened and closed by one or more of any other suitable types of access doors, such as, but not limited to, a basic overhead access door, or a roller shutter or sectional overhead access door. As another option, each of the inner access doors 86 may be in the form of a access door formed by a series of overlapping, flexible strips hanging down from the top of the respective inner access door frame 84.

In the first embodiment, the only path for occupants to move between the subinteriors 70, 72 is by way of the passageway 80. That is, the outer subchamber 74 is positioned between the exterior access opening 40 and the inner subchamber 76, so that the inner subinterior space 72 is for being accessed by way of the outer subinterior space 70. The inner access door frames 84, inner access doors 86 and the passageway 80 (e.g., proximate portions of the interior top, bottom and divider walls 52, 54, 62 and/or any other suitable structures may be cooperative to form or otherwise operate like an airlock. The airlock may be in the form of a chamber between the two airtight inner access doors 86 that are not permitted to open simultaneously.

Figure 3:
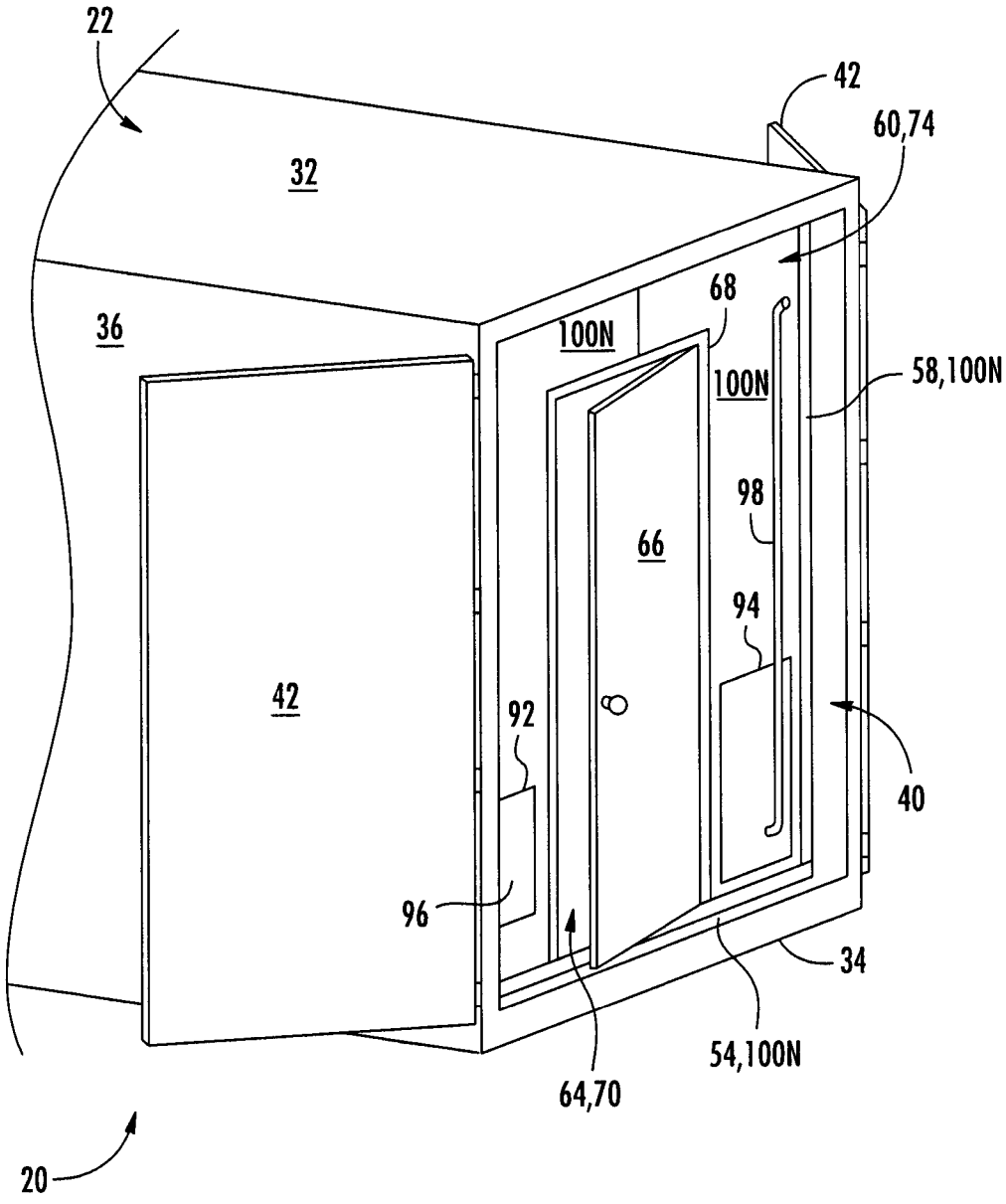
FIG. 3 is a rear pictorial view of a rear portion of the habitat apparatus with an exterior access opening in a fully open configuration, and an outer access opening in a partially open configuration, in accordance with the first embodiment.

At least one of, or both of, the outer and inner subinterior spaces 70, 72 may be adapted for being inhabited by the one or more humans while the portable habitat apparatus 20 is in a radiological environment. The outer subinterior space 70 of the first embodiment is adapted for being temporarily passed through on the way to the inner subinterior space 72, and the outer subinterior space may contain a heating, ventilation, and air conditioning ("HVAC") unit 88, a gasoline engine-powered electrical generator 90, and/or any other suitable utility-type features for supporting the habitat functions of the inner subinterior space 72. The generator 90 may provide all electrical power needed by the habitat apparatus 20/the features associated with the habitat apparatus. Each of these utility-type features (e.g., the HVAC unit 88 and the generator 90) may be positioned in (e.g., substantially positioned in) the outer subinterior space 70. Referring to FIG. 3, one or more utility holes may extend through the interior rear wall 60 for supporting the functionality of these utility-type features, such as by providing one or more intake and exhaust ports 92, 94 positioned on opposite sides of the outer access door 66. In an effort to prevent the exhaust from the generator 90 from passing through the outer access opening 64 while the outer access door 66 is open, the exhaust port 94 is positioned in the section of the interior rear wall 60 to which the outer access door 66 is pivotably mounted by hinges. Each of the ports 92, 94 may be equipped with one or more doors, louvers or other suitable features for opening and closing the port, or the like.

In the first embodiment, the ports 92, 94 accommodate, serve as, or otherwise comprise an air intake vent 96 of the HVAC unit 88 and an exhaust pipe 98 of the generator 90, respectively. More specifically, the intake vent 96 of the HVAC unit 88 may be mounted in the intake port 92, and the exhaust pipe 98 extending from the generator 90 extends out of the outer subinterior space 70 through the exhaust port 94. The exhaust pipe 98 may extend outwardly from the exhaust port 94, and a bend in the exhaust pipe 98 may cause it to extend upwardly along the interior rear wall 60 so that the outlet of the exhaust pipe 98 is proximate an upper corner of the interior rear wall 60. That upper corner is diagonally opposite from the lower corner of the interior rear wall 60 in which, or proximate to which, the intake port 92 is located. This arrangement seeks to keep the exhaust discharged from the exhaust pipe 98 from being drawn into the intake vent 96. Alternatively, if necessary, helpful or otherwise desired, an extension to the exhaust pipe 98 may be provided for routing the exhaust farther upwardly or around a corner of the container 22 in a manner that seeks to keep the exhaust discharged from the exhaust pipe from being drawn into the intake vent 96. Similarly, if necessary, helpful or otherwise desired, an extension could be mounted to the intake vent 96, or the intake vent may be relocated in a manner that seeks to keep the exhaust discharged from the exhaust pipe 98 from being drawn into the intake vent. In one example, the intake port 92 housing the intake vent 96 may be positioned in the exterior right wall 36 in a manner that seeks to keep the exhaust discharged from the exhaust pipe 98 from being drawn into the intake vent.

The HVAC unit 88 further includes filtration media, such as charcoal and high-efficiency particulate air ("HEPA") filters, and at least one discharge vent 99 (FIG. 4) for supplying conditioned air to the inner subinterior space 72. The filtration media is for cleaning the air supplied to the inner subinterior space 72, such as by substantially decontaminating or at least partially decontaminating the air. The discharge vent 99 may be mounted in a hole extending through an upper portion of one of the divider walls 62, for discharging conditioned air into the inner subinterior space 72. The HVAC unit 88 may also include an intake vent positioned for drawing air from within the outer subinterior space 70 or from any other suitable location for recirculating air previously conditioned and discharged by the air discharge vent 99. The HVAC unit 88 may be adapted and the inner subchamber 76/inner subinterior space 72 may be configured so that the atmosphere in the inner subinterior space is maintained at a slightly higher pressure than each of the ambient environment and the atmosphere in the outer subinterior space 70, in a manner that seeks to restrict entry of any airborne contaminants into the inner subinterior space. The relatively high air pressure in the inner subinterior space 72 seeks to cause any air leakage to be from the inside of the interior space to the outside of the interior space, or more specifically from the inside of the inner subinterior space to the outside of the inner subinterior space.

For contrast in the following more detailed discussion of the construction of the chamber structure, the walls 30, 32, 34, 36, 38 of the container 22 may be referred to as exterior walls. The interior front, top, bottom, right and left walls 50, 52, 54, 56, 58 may be in opposing face-to-face configuration with the exterior front, top, bottom, right and left walls 30, 32, 34, 36, 38, respectively. Those opposing face-to-face configurations may more specifically be in the form of opposing face-to-face contacts. On the other hand, a bonding layer of adhesive material may be interposed between one or more of (e.g., each of) those faces so that the chamber structure is mounted to the interior of the container 22. Alternatively or in addition, other mounting features or techniques may be used, although it is preferred (e.g., optional) for the chamber structure to be mounted to the interior of the container 22 without the use of any fasters that penetrate the exterior walls 30, 32, 34, 36, 38. In one example, the interior bottom wall 54 may not be bonded or otherwise adhered to the exterior bottom wall 34, so that the interior bottom wall may be characterized as being free floating, or the like. Whereas in the foregoing and the following, examples of particular constructional configurations of the first embodiment are disclosed, any other suitable constructional arrangements and/or features may be utilized.

In contrast to the outer subinterior space 70, the inner subinterior space 72 of the first embodiment is adapted for being inhabited for extended periods of time while the habitat apparatus 20 is in a radiological environment with relatively high levels of gamma radiation. For example, the inner subinterior space 72 is better suited for being inhabited than the outer subinterior space 70 when the habitat apparatus 20 is in a radiological environment with relatively high levels of gamma radiation. In this regard and as will be discussed in greater detail below, the inner subchamber 76 has a material composition that varies from the material composition of outer subchamber 74 so that the inner subchamber is more effective than the outer subchamber at attenuating radiation. More specifically, the inner subchamber 76 may be adapted for attenuating gamma radiation more effectively than each of the container 22 and the outer subchamber 74.

The variation in the material composition between the subchambers 74, 76, and other variations, may be achieved by constructing the chamber structure from different types of panels. For example, and as will be discussed in greater detail below in accordance with the first embodiment, one type of panel that may be used in the construction of the chamber structure is a structural insulated panel that is not intended for substantially attenuating gamma radiation, and this type of panel may be identified by reference character 100N. As a contrasting example and as will be discussed in greater detail below, another type of panel that may be used in the construction of the chamber structure is a structural insulated panel configured for substantially attenuating radiation, and this type of panel may be referred by the reference character 100A. As will be discussed in greater detail below, panels 100A have a material composition that varies from the material composition of panels 100N, so that panels 100A are more effective than panels 100N at attenuating radiation. Nonetheless and in accordance with the first embodiment, each of the panels 100N, 100A is strong enough to support at least its own weight without deforming substantially. More specifically, each of the panels 100N, 100A may be a structural insulated panel.

In the first embodiment, the chamber structure/subchambers 74, 76 comprise structure in the form of respective ones of the panels 100A, 100N that are cooperative to form the interior front, top, bottom, right, left, rear and divider walls 50, 52, 54, 56, 58, 60, 62. In this regard, each of the interior front, top, bottom, right, left, rear and divider walls 50, 52, 54, 56, 58, 60, 62 is discussed more specifically in the following.

The interior bottom wall 54 includes a series of panels 100N arranged in edge-to-edge abutment with one another and sized so that: the front edge of the interior bottom wall is in opposing face-to-face relation or contact with the lower margin of the interior surface of the exterior front wall 30; the right edge of the interior bottom wall is in opposing face-to-face relation or contact with the lower margin of the interior surface of the exterior right wall 36; the left edge of the interior bottom wall is in opposing face-to-face relation or contact with the lower margin of the interior surface of the exterior left wall 38; and the rear edge of the interior bottom wall extends substantially all the way to/is slightly recessed from the exterior access opening 40 of the container 22, so that the rear edge of the interior bottom wall is in opposing face-to-face relation with the lower margin of the interior surfaces of the exterior access doors 42 when they are closed. Optionally, in some situations, the interior bottom wall 54, or a portion thereof, may be omitted, so that the exterior bottom wall 34 may at least partially define one or more of the access openings 40, 64, 82 and subinterior spaces 70, 72.

The interior front wall 50 includes a series or pair of panels 100A arranged in edge-to-edge abutment with one another and sized so that: the bottom edge of the interior front wall is in opposing face-to-face contact with the front margin of the upper surface of the interior bottom wall 54; the right and left side edges of the interior front wall are in opposing face-to-face contact with front margins of the inner surfaces of the interior right and left side walls 56,58, respectively; and the top edge of the interior front wall is spaced apart from the front margin of the interior surface of the exterior top wall 32, so that a gap is defined between the top edge of the interior front wall and the front margin of the interior surface of the exterior top wall.

For each of the interior right and left side walls 56, 58, the interior side wall includes a series of the panels 100N, 100A arranged in edge-to-edge abutment with one another and sized so that: the bottom edge of the interior side wall is in opposing face-to-face contact with the respective side margin of the upper surface of the interior bottom wall 54; the front edge of the interior side wall is in opposing face-to-face relation or contact with the respective side margin of the interior surface of the exterior front wall 30; the top edge of the interior side wall is spaced apart from the respective side margin of the interior surface of the exterior top wall 32, so that a gap is defined between the top edge of the interior side wall and the respective side margin of the interior surface of the exterior top wall, and the rear edge of the interior side wall extends substantially all the way to/is slightly recessed from the exterior access opening of the container 22, so that the rear edge of the interior side wall is in opposing face-to-face relation with the side margin of the interior surface of the respective exterior access door 42 when it is closed.

The interior rear wall 60 includes a series or pair of panels 100N arranged in edge-to-edge abutment with one another and sized so that: the bottom edge of the interior rear wall is in opposing face-to-face contact with the rear margin of the upper surface of the interior bottom wall 54; the right and left side edges of the interior rear wall are in opposing face-to-face contact with rear margins of the interior right and left side walls 56,58, respectively; and the top edge of the interior rear wall is spaced apart from the rear margin, or the like, of the interior surface of the exterior top wall 32, so that a gap is defined between the top edge of the interior rear wall and the rear margin, or the like, of the interior surface of the exterior top wall.

For each of the interior divider walls 62, the interior divider wall includes series or pair of panels 100A arranged in edge-to-edge abutment with one another and sized so that: the bottom edge of the interior divider wall is in opposing face-to-face contact with the upper surface of the interior bottom wall 54; the outer side edge of the interior divider wall is in opposing face-to-face contact with the inner surface of the respective interior side wall 56, 58; the inner side edge of the interior divider wall is in opposing face-to-face relation with, and spaced apart from, the inner surface of the respective interior side wall 56, 58 so that a portion of the sinuous passageway 80 is defined therebetween; and the top edge of the interior divider wall is spaced apart from the interior surface of the exterior top wall 32, so that a gap is defined between the top edge of the interior divider wall and the interior surface of the exterior top wall.

The interior top wall 52 includes a series of panels 100N, 100A arranged in edge-to-edge abutment with one another and sized so that: the front edge of the interior top wall extends into the gap between the top edge of the interior front wall 50 and the front margin of the interior surface of the exterior top wall 32, so that the front edge of the interior top wall is in opposing face-to-face relation or contact with the upper margin of the interior surface of the exterior front wall 30, and the front margin of the lower surface of the interior top wall is in opposing face-to-face contact with the upper edge of the interior front wall, so that the interior top wall is partially supported by the interior front wall; for each of the right and left side edges of the interior top wall, the side edge extends into the gap between the top edge of the respective interior side wall 56, 58 and the respective side margin of the interior surface of the exterior top wall, so that the side edge of the interior top wall is in opposing face-to-face relation or contact with the upper margin of the interior surface of the respective exterior side wall, and the side margin of the lower surface of the interior top wall is in opposing face-to-face contact with the upper edge of the respective interior side wall 56, 58, so that the interior top wall is partially supported by the interior side walls 56, 58; and the rear edge of the interior top wall extends into the gap between the top edge of the interior rear wall 60 and the rear margin, or the like, of the interior surface of the exterior top wall, so that the rear edge of the interior top wall extends substantially all the way to/is slightly recessed from the exterior access opening of the container 22, so that the rear edge of the interior top wall is in opposing face-to-face relation with the upper margin of the interior surfaces of the exterior access doors 42 when they are closed. In addition, the interior top wall extends through the gaps defined between the top edges of the interior divider walls 62 and the interior surface of the exterior top wall 32, so that the lower surface of the interior top wall is in opposing face-to-face contact with the upper edges of the interior divider walls, so that the interior top wall is partially supported by the interior divider walls.

The panels 100A, 100N of the interior walls 50, 52, 54, 56, 58, 60, 62 may be installed within the container 10 in any suitable sequence. For example, after a panel of the interior bottom wall 54 ("bottom panel") is installed, a panel of the interior right wall 56 ("right panel") may be installed so that: the bottom edge of right panel is in opposing face-to-face contact with the right side margin of the upper surface of the bottom panel; and the top edge of the right panel is spaced apart from the right side margin of the interior surface of the exterior top wall 32, so that a right gap is defined between the top edge of the right panel and the right side margin of the interior surface of the exterior top wall. Then, a panel of the interior top wall 52 ("top panel") may be installed by inserting the right edge of the top panel into the right gap, and raising the left edge of the top panel. Then, a panel of the interior left wall 58 ("left panel") may be installed so that: the bottom edge of left panel is in opposing face-to-face contact with the left side margin of the upper surface of the bottom panel; and the top edge of the left panel is in opposing face-to-face contact with the left side margin of the lower surface of the top panel. The sequence may be repeated, and supplemented accordingly (e.g., by bonding using adhesive material, sealing seams, covering seams and/or any other suitable actions), to complete the construction of the chamber structure/outer and inner subchambers 74, 76 within the container 10. The chamber structure/outer and inner subchambers 74, 76 may be constructed and/or positioned within the container 10 in any other suitable manner.

The outer subchamber 74 may be characterized as being that portion of the chamber structure that is formed by the combination of the interior rear wall 60, the portions of the interior top and side walls 52, 56, 58 that are formed by the panels 100N, and the respective underlying portion of the interior bottom wall 54. In contrast, inner subchamber 76 may be characterized as being that portion of the chamber structure that is formed by the combination of the interior front and divider walls 50, 62, the portions of the interior top and side walls 52, 56, 58 that are formed by the panels 100A, and the respective underlying portion of the interior bottom wall 54. In the first embodiment: proximate, forward and inclusive of the rear interior divider wall 62, the panels 100A are used throughout the interior walls 50, 52, 56, 58, 62, except that the entire interior bottom wall 54 is in the form of the panels 100N; and rearward of the rear interior divider wall 62, the panels 100N are used throughout the interior walls 52, 54, 56, 58, 60. Other arrangements are within the scope of this disclosure. For example and alternatively, the panels 100A may be used throughout the portion of the interior bottom wall 54 that is forward of the rear interior divider wall 62.

Figure 7:
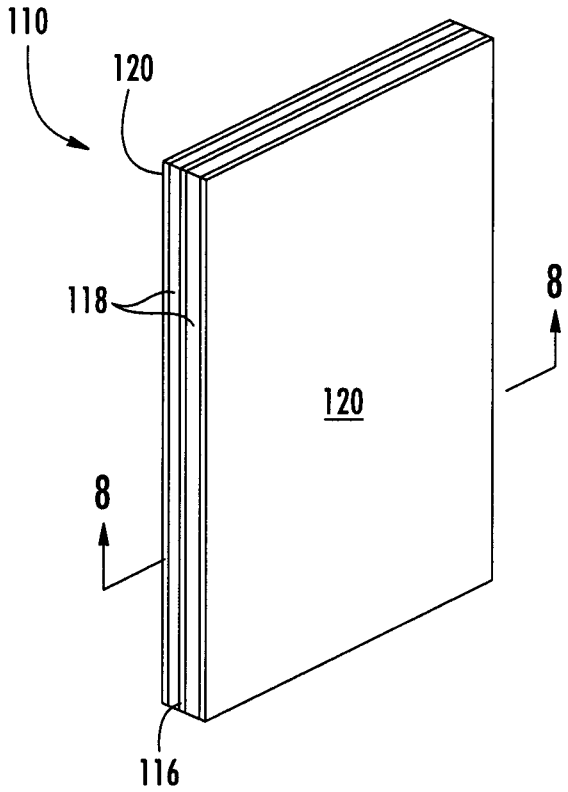
FIG. 7 is an isolated, front pictorial view of an exemplary panel.
Figure 8:
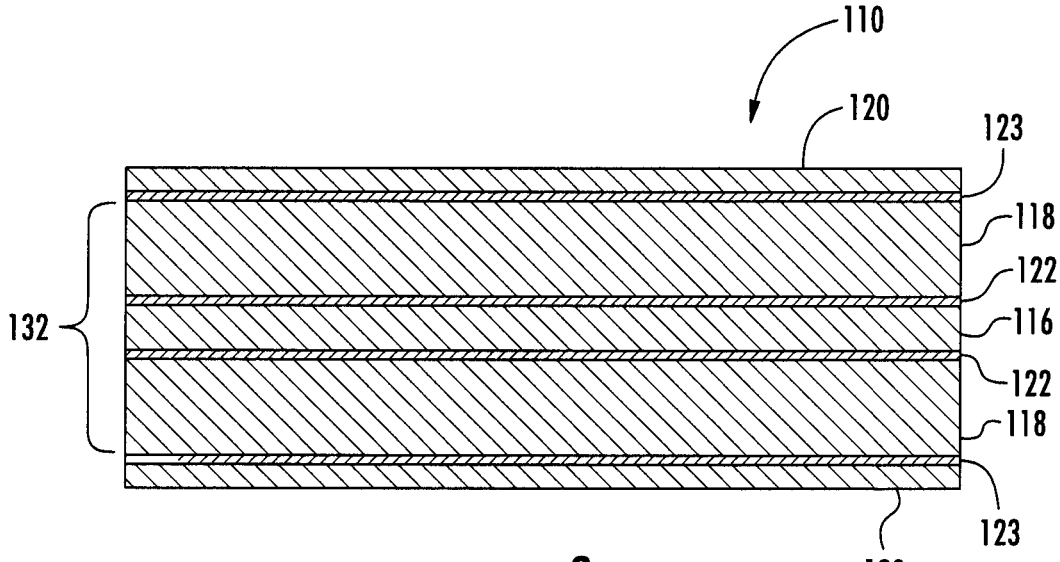
FIG. 8 is a cross-sectional taken along line 8-8 of FIG. 7.

An exemplary panel 110 is shown in FIGS. 7 and 8 and described in the following in accordance with the first embodiment of this disclosure. In accordance with an alternative embodiment, each of the panels of the subchambers 74, 76 are identical to the exemplary panel 110. In contrast, for the first embodiment, the panels of the subchambers 74, 76 vary, but each may be described, for example, with reference to the exemplary panel 110. For example, one group of the panels 100A may be like the exemplary panel 110, other groups of the panels 100A may be variations of the exemplary panel 110, and the panels 100N may be other variation of the exemplary panel 110, as will be discussed in greater detail below.

Referring to FIGS. 7 and 8, the exemplary panel 110 may be a laminate that includes an interior layer 116 positioned between exterior layers 120, and the exemplary panel 110 may optionally further include intermediate layers 118 respectively positioned between the interior and exterior layers. The layers 116, 118, 120 of the exemplary panel 110 may be secured together by bonding layers 122, 123. Any suitable adhesive materials may be used for the bonding layers 122, 123, and one or more of the bonding layers may be omitted. The adhesive materials and other components of the exemplary panel 110 will typically be selected to be durable in the environments in which the exemplary panel may be used. For example, the components of the exemplary panel 110 may be selected so that the exemplary panel will perform satisfactorily for an extended period of time as a barrier to radiation, a structural panel and/or a structural insulated panel. As a specific example, when the exemplary panel 110 is to be used as a barrier to radiation, the components selected for use in the exemplary panel will typically be those types of components that will not degrade, or not degrade too much, when exposed to radiation for an extended period of time. More generally, the components of the exemplary panel 110 may be tailored to the intended usage of the exemplary panel. For example, the exterior layers 120 may be made of metal, such as steel, or stainless steel, for purposes of cleanliness and durability. Alternatively, one or more of the exterior layers 120 may be made of a material other than metal, such as a material having a strong, substantially smooth and non-porous surface that is both durable and easy to clean (e.g., decontaminate, if exposed to radioactive contamination). For example, one or more of the exterior layers 120 may be made of suitable polymeric materials.

In accordance with the first embodiment, the interior layer 116 is operative for functioning as a barrier to radiation, such as by attenuating propagating radiation (e.g., alpha, beta and gamma radiation). Whereas the interior layer 116 may be any suitable material, the interior layer of the first embodiment is a flexible layer comprising polymeric material and metal, wherein the metal is for attenuating radiation. More specifically, the polymeric material comprises silicone and the metal comprises tungsten and/or iron, and the silicone at least partially contains the tungsten and/or iron. Even more specifically, the tungsten and/or iron may be impregnated in the silicone. Even more specifically, the flexible interior layer 116 may consist essentially of silicone impregnated with tungsten and/or iron. The silicone may also or alternatively be impregnated with any other suitable materials. For example, the interior layer 116 may be a flexible layer of Silflex brand radiation shielding material available from, for example, MarShield (Mars Metal Company division of Marswell Metal Industries Ltd.) or American Ceramic Technology, Inc. Alternatively, the interior layer 116 may comprise any other suitable material(s) for attenuating radiation. That is, this disclosure is not limited to the Silflex brand radiation shielding material available from MarShield or American Ceramic Technology, Inc. Any suitable source for the interior layer 116 may be used. Alternatively, the interior layer 116 may comprise any other suitable structure for attenuating radiation, such as, but not limited to, a sheet of lead.

As will be discussed in greater detail below, the interior layer 116 may be mounted to each of the intermediate layers 118 so that the intermediate layers at least partially support the interior layer and/or the combination of the intermediate and exterior layers 118, 120 support the interior layer, and the exterior layers 120 may form a protective cover or shield of the exemplary panel 110. Referring to FIG. 8 and as a more specific example, the interior layer 116 may be a 0.5 inch thick layer of silicone impregnated with tungsten and/or iron (e.g., Silflex brand shielding material), each of the intermediate layers 118 may be a 2.0 inch thick layer of expanded polystyrene foam secured to the opposite sides of the interior layer by respective inner bonding layers 122, and each of the exterior layers 120 may be a piece of sheet metal respectively secured to the intermediate layers by respective outer bonding layers 123. The sheet metal may be coated, such as with paint. The exterior layers 120 may be twenty six gauge steel sheet metal, and typically the exterior layers may be ferromagnetic, as will be discussed in greater detail below. The exterior layers may also be stainless steel sheet metal. The exemplary panel 110 may have any suitable overall width and height, such as for being fitted into the container 10 as discussed above. For example, the exemplary panel 110 may have an overall width of forty-six inches, and a height of eighty inches. Each of the above-mentioned dimensions may be approximate, and may vary by plus or minus any suitable percentage, such as five, ten, fifteen, twenty, twenty-five and/or any other suitable percentage. More generally, a wide variety of dimensions and/or other variations are within the scope of this disclosure. For example, one or more of the layers 116, 118, 120, 122, 123 may be omitted, although the interior layer 116 will typically be included when it is desired to attenuate radiation (e.g., gamma radiation). As another example, radiation attenuation can be increased or decreased by changing the thickness of the interior layer 116 and/or the characteristics of the interior layer (e.g., changing the amount and/or type of the metal in the interior layer). Dimensions and other features of the panel 110 may vary depending upon any space constraints, cost constraints, amount of radiation attenuation desired, preferences and/or any other relevant factors.

In the first embodiment, the edges of each of the layers 116, 118, 120 extend substantially all the way to and are substantially coextensive with respective edges of the exemplary panel 110. At least partially reiterating from above and in accordance with the first embodiment, the interior layer 116 in isolation may be a flexible sheet of material for restricting the propagation of radiation therethrough, and the edges of the interior layer respectively extend substantially all the way to and are substantially coextensive with the respective edges of the exemplary panel 110 in an effort to maximize the breadth of the shielding provided by the interior layer. For securing the interior layer 116 in its broadly spread configuration, the interior layer 116 is secured between, and to both of, the intermediate layers 118 by the respective inner bonding layers 122, and the edges of the inner bonding layers respectively extend substantially all the way to and are substantially coextensive with the respective edges of the exemplary panel 110. The intermediate layers 118 and/or the intermediate layers 118 in combination with the exterior layers 120 are typically more rigid than the interior layer 116. In one embodiment, the combinations of the intermediate and exterior layers 118, 120 (e.g., outer laminates comprising the intermediate and exterior layers), optionally further in combination with the inner bonding layers 122, are cooperative to support the intermediate layer in its broad configuration in which the edges of the intermediate layer extend substantially all the way to and are substantially coextensive with the respective edges of the exemplary panel 110.

In one aspect of this disclosure, the exemplary panel 110 may be characterized as including a core or central laminate 132 (FIG. 8) that comprises the interior and intermediate layers 116, 118 with the respective inner bonding layers 122 therebetween. As one example of a method of forming the central laminate 132, a first of the intermediate layers 116 of the central laminate may be laid out horizontally, the upper surface first intermediate layer may be substantially completely covered with a first layer of adhesive material (for forming a first of the bonding layers 122), the interior layer 116 of the central laminate may be laid out over/onto the first layer of adhesive material in a substantially superposed relationship with the first intermediate layer, the second of the intermediate layers of the central laminate may be laid out horizontally, the upper surface second intermediate layer may be substantially completely covered with a second layer of adhesive material (for forming the second of the bonding layers), and the laminate of first intermediate layer, first bonding layer and interior layer may be laid out over/onto the second layer of adhesive material so that the interior layer and the first and second intermediate layers are all substantially superposed with one another, and the opposite sides of the interior layer are respectively in opposing face-to-face contact with the bonding layers. The exterior layers 120 may be mounted to the opposite sides of the central laminate 132 in a similar manner.

Alternatively, the central laminate 132 and/or the exemplary panel 110 may be formed in any other suitable manner. For example, in the central laminate 132, the bonding layers 122 may be omitted, so that the intermediate layers 118 are in direct opposing face-to-face contact with/are directly bonded to the interior layer 116. That is, the materials of the interior and intermediate layers 116, 118 may be selected so that the bonding layers 122 of adhesive material may be omitted. For example, the interior layer 116 may be formed and cured integrally with the intermediate layers 118 so that the intermediate layers are directly bonded to the interior layer without the bonding layers 122. For example, the intermediate layers 118 may be extruded onto the interior layer 116 and/or the intermediate and interior layers may be coextruded so that the intermediate layers are directly bonded to the interior layer without the bonding layers 122. Alternatively, any suitable materials (e.g., the bonding layers 122 of adhesive material) may be interposed between the interior and intermediate layers 116, 118. As another example, one or both of the intermediate layers 118 and bonding layers 122 may be omitted, in which case the interior layer 116 may be secured to one or more of the exterior layers 120, such as by way of one or more of the outer bonding layers 123. Other variations are within the scope of this disclosure, and examples of some of the possible variations are discussed below.

In accordance with the first embodiment, and as may be best understood by simultaneously referring to FIGS. 4-8, each of the panels 100A includes at least the interior layer 116 that is operative for functioning as a barrier to radiation, such that each of the panels 100A may be adapted for attenuating gamma radiation more effectively than at least one of, typically each of, the exterior walls 30, 32, 34, 36, 38 of the container 22. For this comparison of effectiveness, the gamma radiation was considered to be perpendicularly incident upon a major surface of the panel 100A, and likewise the gamma radiation was considered to be perpendicularly incident upon a major surface of the respective exterior wall 30, 32, 34, 36, 38. For each of the panels 100A, one or more other layers 118, 120, 122, 123 may be omitted.

In contrast, to the panels 100A, the panels 100N do not include the interior layer 116, and similarly one or more of the other layers 118, 120, 122, 123 may be omitted. Notwithstanding the foregoing, in the first embodiment, for purposes of cleanliness and durability, each of the panels 100A, 100N includes at least one of the exterior layers 120 that is facing a respective one of the subinterior spaces 70, 72. More specific examples of the panels of the first embodiment are described in the following for illustrative purposes, and not for the purpose of limiting the scope of this disclosure.

Each of the panels 100A of the interior divider walls 62 may be like the exemplary panel 110. As another example, each of the panels 100A of the interior divider walls 62 may be a laminate comprising the interior layer 116 laminated between two structural insulated panels, wherein each of the structural insulated panels is about two inches thick.

Each of the panels 100A of the interior front, top, right and left walls 50, 52, 56, 58 may be like the exemplary panel 110, except for omitting: one of the inner bonding layers 122; a respective one of the intermediate layers 118; a respective one of the exterior layers 120; and a respective one of the outer bonding layer 123. As another example, each of the panels 100A of the interior top wall 52 may be a laminate comprising the interior layer 116 laminated to a structural insulated panel that is about four inches thick. As a further example, each of the panels 100A of the interior right and left walls 56, 58 may be a laminate comprising the interior layer 116 laminated to a structural insulated panel that is about two inches thick.

Each of the panels 100N of the interior top, bottom, right and left walls 52, 54, 56, 58 may be like the exemplary panel 110, except for omitting: each of the interior and inner bonding layers 116, 122; one of the intermediate layers 118; a respective one of the exterior layers 120; and a respective one of the outer bonding layer 123. As another example, each of the panels 100N of the interior top wall 52 may be a structural insulated panel that is about four inches thick. As another example, each of the panels 100N of the interior bottom wall 54 may be a structural insulated panel that is about two inches thick. As a further example, each of the panels 100N of the interior right and left walls 56, 58 may be a structural insulated panel that is about two inches thick. The panels 100N of the interior rear wall 60 may be like the exemplary panel 110, except for omitting each of the interior and inner bonding layers 116, 122, and one of the intermediate layers 118. As another example, each of the panels 100N of the interior rear wall 60 may be a structural insulated panel that is about four inches thick.

As mentioned above for the first embodiment, adjacent panels 100A, 100N abut one another, and each of the panels 100A, 100N includes at least one of the exterior layers 120 that is facing a respective one of the subinterior spaces 70, 72. Accordingly, there are seams at the junction between adjacent panels 100A, 100N, and the portions of the seams facing the subinterior spaces 70, 72 are defined between adjacent exterior layers 120. If desired, these seams between adjacent exterior layers 120 may be sealed or otherwise covered by weld beads, covering strips, and/or the like, and the weld beads, covering strips, and/or the like, may optionally serve to respectively fasten adjacent panels 100A, 100N to one another. For example, the seams may be covered with strips of adhesive-backed tape, such as durable, strong tape or any other suitable structure. For example and not limitation, such a tape may be an adhesive-backed strip of metal foil. Such tape may more specifically comprise a flexible strip that comprises polymeric material and metal for attenuating radiation, a flexible strip of silicone impregnated with metal, a flexible strip that comprises silicone impregnated with tungsten and/or iron, or more specifically such tape may consist essentially of adhesive-backed silicone impregnated with tungsten and/or iron. As a more specific example, the seams may be covered with Silflex brand shielding material, or any other suitable silicone tungsten/iron attenuation product, that is in the form of adhesive-backed tape, or the like. Alternatively, the strips for covering the seams may be backed with magnetic material for attaching to the ferromagnetic exterior layers 120 of the panels. As indicated previously, this disclosure is not limited to the Silflex brand radiation shielding material available from MarShield or American Ceramic Technology, Inc.

If desired, any exposed edges of the panels 100A, 100N, such as at the free edges of the interior divider walls 62 and the rear edge of the interior bottom wall 54, may be covered with an edge cover or any other suitable structure. For example, edge covers may be mounted to any free edges of the panels, such as for protecting the free edges, and the edge covers may be constructed of the same material as the exterior layers 120, for purposes of cleanliness and durability. Each edge cover may be a generally C or U-shaped structural channel member having a web and flanges extending from the web. Each edge cover may be constructed of metal, steel, or any other suitable material. For each edge cover, the flanges may be substantially parallel to one another and extend substantially perpendicularly away from opposite edges of the web, so that a groove is defined by the edge cover. The groove is for being in receipt of the free edge of the panel, and may be sized to provide an interference or friction fit. Not only may such a tight fit hold, or at least partially hold, the edge of the panel together, it may also seek to minimize any open areas that may receive and harbor any contaminants to which the panel may be exposed. In addition or alternatively, the edge cover may be mounted to the edge of the panel in any other suitable manner, such as with adhesive material and/or in any other suitable manner. As another example, each edge cover may be formed of one or more strips of adhesive-backed tape, such as durable, strong tape or any other suitable structure. For example and not limitation, such a tape may be an adhesive-backed strip of metal foil. Whereas the tape from which the edge covers may be formed may be any suitable material, the tape may more specifically comprise a flexible strip that comprises polymeric material and metal for attenuating radiation, a flexible strip of silicone impregnated with metal, a flexible strip that comprises silicone impregnated with tungsten and/or iron, or more specifically the edge covers may consist essentially of adhesive-backed silicone impregnated with tungsten and/or iron. As a more specific example, the edge covers may be formed from or at least partially formed from, Silflex brand shielding material that is in the form of tape.

The subinterior spaces 70, 72 of the habitat apparatus 20 may be equipped with a variety of features for enhancing the habitability of the habitat apparatus and/or of use in decontaminating any radioactive contamination from people and/or objects entering the habitat apparatus. For example, and as will be understood by those familiar with decontamination procedures, a "step off area" may be defined in the outer subinterior space 70 adjacent to the sinuous passageway 80, and a cleaning station/wipe down station may be in the in the outer subinterior space adjacent to the step off area. Also one or more of each of the following may be contained in the inner subinterior space 70: interior lighting, a work station, communication station, computer, chair, table, bed, microwave oven, water cooler, refrigerator, television, radio and/or any other features that promote habitability. The contents within the subinterior spaces 70, 72 may be mounted or otherwise secured, anchored, or the like, for facilitating the portability of the habitat apparatus 20.

In accordance with the first embodiment, the habitat apparatus 20 may be transported, such as in route to a radiological emergency, in any suitable manner. For example: the habitat apparatus 20 may be mounted, in a conventional manner, on a conventional flatbed semi-trailer 130 (FIG. 9), and the flatbed semi-trailer may be pulled by a tractor vehicle in a conventional manner; the habitat apparatus may be mounted, in a conventional manner, on a railroad car, and the railroad car may be pulled by a locomotive in a conventional manner; and/or the habitat apparatus may be mounted, in a conventional manner, on a ship, and the ship may carry the habitat apparatus in a conventional manner. At its final destination, the habitat apparatus 20 may remain on the flatbed semi-trailer 130, railroad car or ship, or the habitat apparatus may be removed and placed upon the ground or any other suitable structure.

Figure 9:
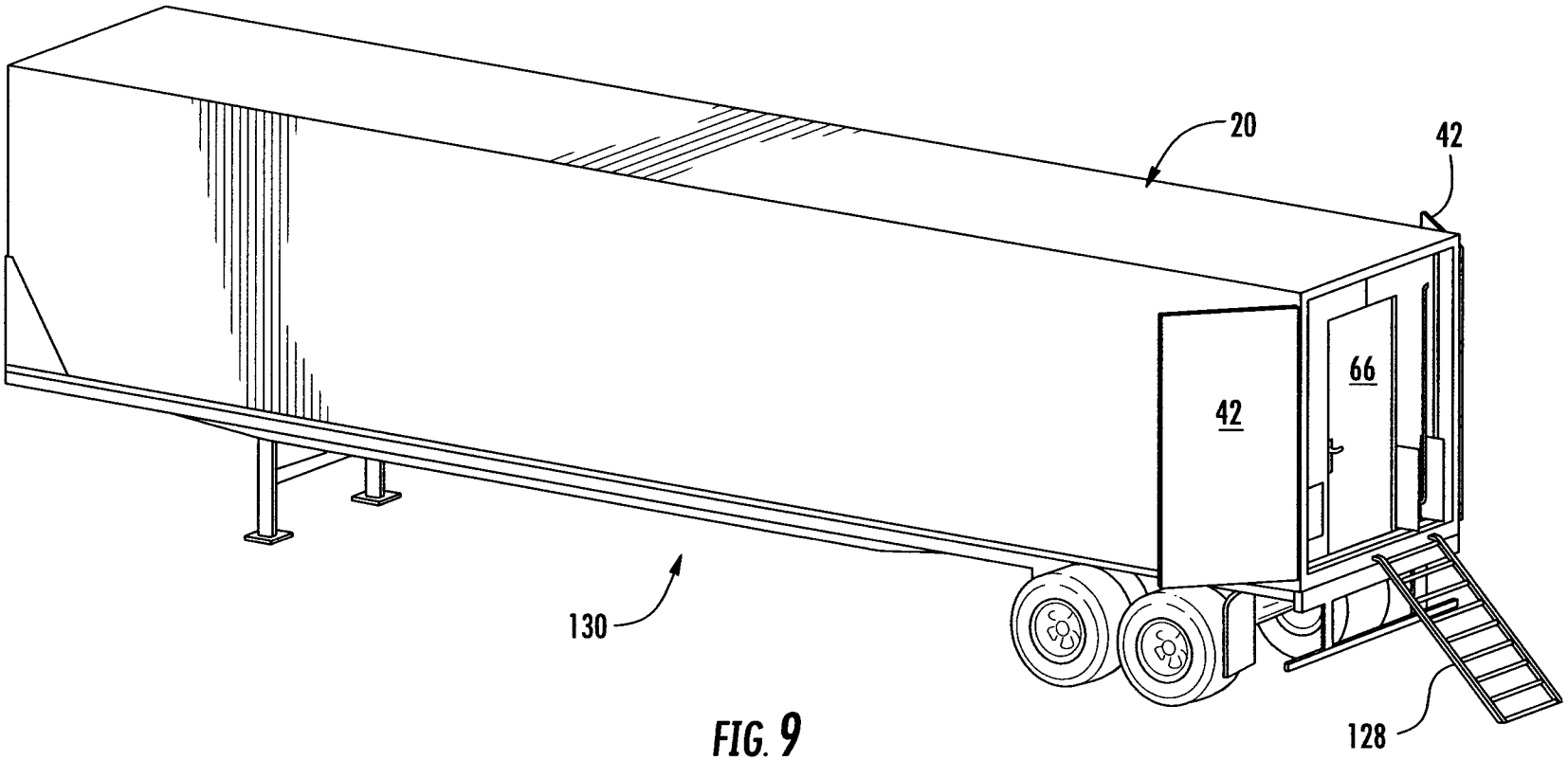
FIG. 9 illustrates the habitat apparatus mounted on a flatbed semi-trailer.

A detachable set of somewhat ladder-like stairs 128 are shown positioned for providing access to the outer access door 66. Whereas FIG. 9 illustrates the habitat apparatus 20 of the first embodiment mounted on a conventional flatbed semi-trailer 130, FIG. 9 also schematically illustrates a habitat apparatus of a second embodiment of this disclosure. In accordance with the second embodiment, the habitat apparatus may be constructed by outfitting box-shaped semi-trailer, or more specifically a substantially parallelepipedal semi-trailer. The second embodiment is like the first embodiment, except for variations noted and variations that will be apparent to one of ordinary skill in the art. A third embodiment of this disclosure may be like either of the first or second embodiments, except, for example, each of the panels of the subchambers 74, 76 of the third embodiment may be identical to the exemplary panel 110, or the like. For example, each of the panels 100N may be replaced with one of the panels 100A, or the like. A variety of other variations are also within the scope of this disclosure. As another option, for each of the interior divider walls 62, the bottom edge of the interior divider wall may extend into mating notch or groove defined in the upper surface of the interior bottom wall 54, and the top edge of the interior divider wall may extend into mating notch or groove defined in the lower surface of the interior top wall 52. Also, the container 22 may be more specifically characterized as an outer container, since the chamber structure (e.g., the subchambers 74, 76) may be in the form of a container, containers, or the like, located within the outer container.

In a fourth embodiment of this disclosure, the interior layer 116 is omitted from the panels 100A (e.g., the panels 100N may be substituted for the panels 100A), and the variation in the material composition between the subchambers 74, 76 is achieved by completely lining the entire interior surface of the exterior front wall 30 and those portions of the interior surfaces of the exterior top, right and left walls 32, 36, 38 that extend from proximate the rearward most divider wall 62 to the front wall. The lining may be characterized as being part of the inner subchamber, the lining may be in the form of a flexible layer like the interior layer 116, and the lining may be laminated or otherwise mounted to the respective interior surfaces of the container, such as through the use of adhesive material and/or any other suitable means, prior to installing the panels. That is, the lining may be covered by, and protected by, the respective panels. The lining of the fourth embodiment may comprise any other suitable structure for attenuating radiation, such as, but not limited to, a sheet of lead. In the fourth embodiment, any suitable panels may be used, such as any suitable structural insulated panels, which may be like the panel 110 except for omitting the interior layer 116, and optionally also omitting one or more other layers.

Directional references (e.g., top, upper, lower, bottom, front, back, rear, left, right, top, bottom, above, below, crosswise and the like) have been used in this disclosure for ease of understanding and not for the purpose of limiting the scope of this disclosure. Accordingly, while the present disclosure has generally been provided in terms of certain illustrated configurations, directional references related thereto are provided only for example.

The above examples are in no way intended to limit the scope of the present invention. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A portable habitat apparatus for being used in a radiological environment and for being occupied by one or more humans, the apparatus comprising:

an outer container adapted for being portable and free-standing, said outer container comprising a plurality of exterior walls that are respectively connected to one another, an opening, and at least one door mounted for opening and closing said opening of said outer container; and a chamber structure positioned in said outer container, wherein said chamber structure extends at least partially around and at least partially defines an interior space adapted for being inhabited by the one or more humans, said interior space is positioned in said outer container, said outer container and said chamber structure are cooperatively configured so that said interior space is for being accessed by way of said opening of said outer container, said chamber structure comprises a plurality of structural panels that each include a layer comprising polymeric material and metal, and said metal is for attenuating radiation, and at least a substantial portion of said chamber structure is adapted for attenuating gamma radiation more effectively than said outer container.

2. The apparatus according to claim 1, wherein:

said polymeric material comprises silicone;

said metal comprises at least one metal selected from the group consisting of tungsten and iron; and said metal is impregnated in said silicone.

3. The apparatus according to claim 1, wherein:

said chamber structure comprises a plurality of interior walls that extends at least partially around and at least partially defines said interior space, on a per unit area basis, at least one interior wall of said plurality of interior walls is adapted for attenuating gamma radiation more effectively than at least one exterior wall of said plurality of exterior walls when comparing gamma radiation perpendicularly incident upon a major surface of said at least one interior wall, and gamma radiation perpendicularly incident upon a major surface of said at least one exterior wall.

4. A portable habitat apparatus for being used in a radiological environment and for being occupied by one or more humans, the apparatus comprising:

an outer container adapted for being portable and free-standing, said outer container comprising a plurality of exterior walls that are respectively connected to one another, an opening, and at least one door mounted for opening and closing said opening of said outer container; and a chamber structure positioned in said outer container, wherein said chamber structure extends at least partially around and at least partially defines an interior space adapted for being inhabited by the one or more humans, said interior space is positioned in said outer container, said outer container and said chamber structure are cooperatively configured so that said interior space is for being accessed by way of said opening of said outer container, at least a substantial portion of said chamber structure is adapted for attenuating gamma radiation more effectively than said outer container, said chamber structure comprises first and second subchamber structures;

said interior space comprises first and second subinterior spaces that are respectively at least partially defined by said first and second subchamber structures;

at least one of said first and second subinterior spaces is adapted for being inhabited by the one or more humans;

said first subchamber structure is positioned between said opening of said outer container and said second subchamber structure, so that said second subinterior space is for being accessed by way of said first subinterior space; and said second subchamber is adapted for attenuating gamma radiation more effectively than said first subchamber structure, said first subchamber structure at least partially defines an opening to said first subinterior space;

said opening to said first subinterior space is adjacent said opening of said outer container, and for providing access to said first subinterior space; and said second subchamber structure at least partially defines an opening for providing access from said first subinterior space to said second subinterior space.

5. The apparatus according to claim 4, wherein:

said chamber structure at least partially defines an opening to said interior space;

said opening to said interior space is adjacent said opening of said outer container, and for providing access to said interior space; and said chamber structure includes at least one door for opening and closing said opening to said first subinterior space.

6. The apparatus according to claim 1, wherein said outer container is selected from the group consisting of a substantially parallelepipedal intermodal container and a substantially parallelepipedal trailer.

7. In combination with a flatbed semi-trailer, a portable habitat apparatus for being used in a radiological environment and for being occupied by one or more humans, the apparatus comprising:

an outer container adapted for being portable and free-standing, said outer container comprising a plurality of exterior walls that are respectively connected to one another, an opening, and at least one door mounted for opening and closing said opening of said outer container; and a chamber structure positioned in said outer container, wherein said chamber structure extends at least partially around and at least partially defines an interior space adapted for being inhabited by the one or more humans, said interior space is positioned in said outer container, said outer container and said chamber structure are cooperatively configured so that said interior space is for being accessed by way of said opening of said outer container, and at least a substantial portion of said chamber structure is adapted for attenuating gamma radiation more effectively than said outer container, wherein said outer container is an intermodal container, and said intermodal container is mounted on said flatbed semi-trailer.

8. A portable habitat apparatus for being used in a radiological environment and for being occupied by one or more humans, the apparatus comprising:

an outer container adapted for being portable and free-standing, said outer container comprising an opening, at least one door for opening and closing said opening of said outer container, and upright first and second walls positioned at opposite sides of said outer container; and a chamber structure positioned in said outer container, wherein said chamber structure extends at least partially around and at least partially defines an interior space adapted for being inhabited by the one or more humans, said interior space is positioned in said outer container, said outer container and said chamber structure are cooperatively configured so that said interior space is for being accessed by way of said opening of said outer container, said chamber structure comprises an upright first structural panel proximate and extending along said first wall, an upright second structural panel proximate and extending along said second wall, wherein said first and second structural panels are respectively positioned at said opposite sides of said interior space, and an upper structural panel spanning between and supported by each of an upper edge of said first structural panel and an upper edge of said second structural panel, at least one of said first, second and upper structural panels being configured for substantially attenuating at least gamma radiation, wherein each of said first, second and upper structural panels includes a layer comprising polymeric material and metal, and said metal is for attenuating radiation.

9. The apparatus according to claim 8, wherein each of said first, second and third structural panels is a laminated, structural insulated panel that is configured for substantially attenuating at least gamma radiation.

10. The apparatus according to claim 8, wherein:

said polymeric material comprises silicone;

said metal comprises at least one metal selected from the group consisting of tungsten and iron; and said silicone at least partially contains said metal.

11. A portable habitat apparatus for being used in a radiological environment and for being occupied by one or more humans, the apparatus comprising:

an outer container adapted for being portable and free-standing, said outer container comprising an opening, at least one door for opening and closing said opening of said outer container, and upright first and second walls positioned at opposite sides of said outer container; and a chamber structure positioned in said outer container, wherein said chamber structure extends at least partially around and at least partially defines an interior space adapted for being inhabited by the one or more humans, said interior space is positioned in said outer container, said outer container and said chamber structure are cooperatively configured so that said interior space is for being accessed by way of said opening of said outer container, said chamber structure comprises an upright first structural panel proximate and extending along said first wall, an upright second structural panel proximate and extending along said second wall, wherein said first and second structural panels are respectively positioned at said opposite sides of said interior space, and an upper structural panel spanning between and supported by each of an upper edge of said first structural panel and an upper edge of said second structural panel, at least one of said first, second and upper structural panels being configured for substantially attenuating at least gamma radiation;

wherein:

said opening of said outer container is positioned between an end of said first wall and an end of said second wall;

said at least one door of said outer container comprises first and second doors respectively pivotably mounted to said end of said first wall and said end of said second wall;

said chamber structure includes a wall that is adjacent said opening of said outer container,
is positioned in said interior of said outer container,
extends crosswise to first and second walls of said of said outer container, and
at least partially defines an opening to said interior space; and said chamber structure includes at least one door for opening and closing said opening to said interior space, and said at least one door of said chamber structure is pivotably mounted to said wall of said chamber structure.

12. The apparatus according to claim 11, wherein:

said chamber structure further includes an upright third structural panel proximate and extending along said first wall, said third structural panel is positioned between said first structural panel and said opening to said interior container, and said first structural panel has a material composition that varies from a material composition of said third structural panel so that first structural panel is more effective than said third structural panel at attenuating radiation.

13. The apparatus according to claim 8, wherein:

said first structural panel is substantially parallel to, and bonded with adhesive material to, said first wall; and said second structural panel is substantially parallel to, and bonded with adhesive material to, said second wall.

14. The apparatus according to claim 8, wherein:

said outer container is a substantially parallelepipedal and has
opposite first and second ends, wherein said opening of said outer container is positioned at said first end, and
top, bottom, right and left walls each extending between said first and second ends;

said at least one door of said outer container comprises right and left doors respectively pivotably mounted to proximate said right and left walls for opening and closing said opening of said outer container; and said chamber structure extends, within said outer container, substantially to said second end of said outer container.

15. The apparatus according to claim 8, wherein said outer container is selected from the group consisting of a substantially parallelepipedal intermodal container and a substantially parallelepipedal trailer.

16. A portable habitat apparatus for being used in a radiological environment and for being occupied by one or more humans, the apparatus comprising:

an outer container comprising
an opening, and
at least one door for opening and closing said opening of said outer container; and at least one chamber structure positioned in said outer container, wherein said at least one chamber structure at least partially defines first and second interior spaces that are each positioned in said outer container, said first interior space is for being accessed by way of said opening of said outer container, said second interior space is for being accessed by way of said first interior space, and said at least one chamber structure extends at least partially around said second interior space and is adapted for attenuating gamma radiation more effectively than said outer container, so that second interior space is adapted for being inhabited by the one or more humans at any time when the apparatus is in the radiological environment, said at least one chamber structure at least partially defines an opening to said first interior space;

said opening to said first interior space is
adjacent said opening of said outer container, and
for providing access to said first interior space; and said at least one chamber structure includes at least one door for opening and closing said opening to said first interior space.

17. The apparatus according to claim 16, wherein:

said at least one chamber structure comprises first and second subchamber structures that respectively define said first and second interior spaces;

said first subchamber structure is positioned between said opening of said outer container and said second subchamber structure, so that said second interior space is for being accessed by way of said first interior space; and said second subchamber structure is adapted for attenuating gamma radiation more effectively than each of said outer container and said first subchamber structure.

18. A method of providing a portable habitat apparatus for being used in a radiological environment and for being occupied by one or more humans, the method comprising:

obtaining a container that is configured for being freestanding and portable, wherein the container comprises
a plurality of exterior walls that are respectively connected to one another,
an opening, and
at least one door mounted for opening and closing the opening of the container;

then outfitting the container so that an interior space positioned in the container is suitable for being inhabited by the one or more humans at any time when the apparatus is in the radiological environment, wherein the outfitting comprises constructing a chamber structure within the container so that
the chamber structure is mounted within the container for traveling with the container,
the chamber structure extends at least partially around and at least partially defines the interior space,
at least a substantial portion of the chamber structure is adapted for attenuating gamma radiation more effectively than the container, and
the interior space is for being accessed by way of the opening of the container; and delivering the apparatus to the radiological environment, wherein:
the container is a trailer; and
the delivering comprises pulling the trailer with a tractor vehicle.

19. A method of providing a portable habitat apparatus for being used in a radiological environment and for being occupied by one or more humans, the method comprising:

obtaining a container that is configured for being freestanding and portable, wherein the container comprises
a plurality of exterior walls that are respectively connected to one another,
an opening, and
at least one door mounted for opening and closing the opening of the container;

then outfitting the container so that an interior space positioned in the container is suitable for being inhabited by the one or more humans at any time when the apparatus is in the radiological environment, wherein the outfitting comprises constructing a chamber structure within the container so that
the chamber structure is mounted within the container for traveling with the container, the chamber structure extends at least partially around and at least partially defines the interior space, at least a substantial portion of the chamber structure is adapted for attenuating gamma radiation more effectively than the container, and the interior space is for being accessed by way of the opening of the container; and delivering the apparatus to the radiological environment, wherein:

the container is an intermodal container; and the delivering comprises transporting the intermodal container by at least one mode of transportation selected from the group consisting of mounting the intermodal container on a flatbed semi-trailer and pulling the flatbed semi-trailer with a tractor vehicle, mounting the intermodal container on a railroad car and pulling the railroad car with a locomotive, and mounting the intermodal container on a ship and operating the ship so that the ship carries the container.

* * * * *